US009714787B2

(12) United States Patent
Lee et al.

(10) Patent No.: US 9,714,787 B2
(45) Date of Patent: Jul. 25, 2017

(54) REFRIGERATOR

(71) Applicant: LG ELECTRONICS INC., Seoul (KR)

(72) Inventors: Taehee Lee, Seoul (KR); Dongseok Kim, Seoul (KR)

(73) Assignee: LG ELECTROINCS INC., Seoul (KR)

( * ) Notice: Subject to any disclaimer, the term of this patent is extended or adjusted under 35 U.S.C. 154(b) by 82 days.

(21) Appl. No.: 14/245,599

(22) Filed: Apr. 4, 2014

(65) Prior Publication Data

US 2014/0298850 A1 Oct. 9, 2014

(30) Foreign Application Priority Data

Apr. 8, 2013 (KR) ..... 10-2013-0038265

(51) Int. Cl.

| | |
|---|---|
| ***F25D 21/04*** | (2006.01) |
| ***F25B 7/00*** | (2006.01) |
| ***F28D 1/04*** | (2006.01) |
| ***F28D 1/047*** | (2006.01) |
| ***F28D 7/10*** | (2006.01) |
| ***F28F 1/32*** | (2006.01) |

(Continued)

(52) U.S. Cl.

CPC ..... *F25D 21/04* (2013.01); *F25B 7/00* (2013.01); *F28D 1/0408* (2013.01); *F28D 1/0461* (2013.01); *F28D 1/0477* (2013.01); *F28D 7/106* (2013.01); *F28F 1/32* (2013.01); *F25B 23/006* (2013.01); *F25B 39/04* (2013.01); *F28D 2021/007* (2013.01); *F28F 2215/02* (2013.01)

(58) Field of Classification Search

CPC ..... F25D 23/003; F25D 23/061; F25D 2321/1412; F25D 7/106; F25D 7/0075; F25D 7/0091; F25D 1/0408; F25D 1/0426; F25D 1/0461; F25D 2021/007; F25B 39/04; F25B 23/006; F25B 7/00; F25B 25/00; F25B 25/005; F28D 7/10; F28D 2021/007; F28D 1/0226; F28F 3/06; F28F 1/32; F28B 1/02; F28B 1/06; F28B 9/06; F27D 7/10; F27D 7/106; F27D 1/0408; F27D 1/0426; F27D 1/0461

USPC ..... 62/333, 181, 138, 184, 305, 506; 165/154, 140, 141

See application file for complete search history.

(56) References Cited

U.S. PATENT DOCUMENTS 2,318,891 A * 5/1943 Sidell ..... F25B 49/027 165/144

3,984,223 A * 10/1976 Whistler, Jr. ..... F25D 21/04 62/277

(Continued)

*Primary Examiner* — Christopher R Zerphey

(74) *Attorney, Agent, or Firm* — KED & Associates, LLP

(57) ABSTRACT

A refrigerator is provided. The refrigerator may include a body having storage chambers formed therein, and a compressor, a condenser, an expansion device, and an evaporator that form a refrigerating cycle to cool the storage chambers. The condenser may include a refrigerant condensation channel through which refrigerant from the compressor passes and a working fluid evaporation channel through which working fluid is evaporated due to heat exchange with the refrigerant passing through the refrigerant condensation channel. The condenser may be connected with a hot line, through which the working fluid evaporated through the working fluid evaporation channel flows and discharges heat to reduce condensation.

7 Claims, 4 Drawing Sheets

(51) Int. Cl.

| | |
|---|---|
| *F25B 23/00* | (2006.01) |
| *F25B 39/04* | (2006.01) |
| *F28D 21/00* | (2006.01) |

(56) References Cited

U.S. PATENT DOCUMENTS

| | | | | | |
|---|---|---|---|---|---|
| 4,383,421 | A * | 5/1983 | Quesnoit | F25B 5/04 | 62/333 |
| 5,186,242 | A * | 2/1993 | Adachi | B60H 1/3202 | 165/104.27 |
| 5,255,531 | A * | 10/1993 | Williams | F25D 23/028 | 312/406 |
| 5,816,063 | A * | 10/1998 | Schulak | F25D 16/00 | 165/45 |
| 2003/0209025 | A1* | 11/2003 | Lee | F25D 21/04 | 62/272 |
| 2005/0198995 | A1* | 9/2005 | Lee | F25B 49/027 | 62/506 |

* cited by examiner

REFRIGERATOR

CROSS-REFERENCE TO RELATED APPLICATION(S)

This application claims priority under 35 U.S.C. §119 to Korean Application No. 10-2013-0038265 filed on Apr. 8, 2013, whose entire disclosure is hereby incorporated by reference.

BACKGROUND

1. Field

This relates to a refrigerator, and in particular to a refrigerator equipped to prevent condensation.

2. Background

Refrigerators may cool storing chambers, using a refrigeration cycle including a compressor, a condenser, an expansion device, and an evaporator.

Refrigerators may include a body with storing chambers such as a freezer compartment, doors connected to the body to open/close the storing chambers, a blower fan circulating the air in the storing chambers through the evaporator and the storing chambers, and a condenser fan sending air to the condenser. Condensation may occur at a portion of the body in contact the door when a difference in temperature between the inside of the refrigerator and the outside is relatively high due to a high temperature/high humidity external environment. In particular, condensation may accumulate at the contact portion between the door and the body due to the temperature difference between the inside and the outside of the refrigerator.

BRIEF DESCRIPTION OF THE DRAWINGS

The embodiments will be described in detail with reference to the following drawings in which like reference numerals refer to like elements wherein.

DETAILED DESCRIPTION

Hereinafter, a refrigerator according embodiments as broadly described herein will be described with reference to the accompanying drawings.

Figure 1:
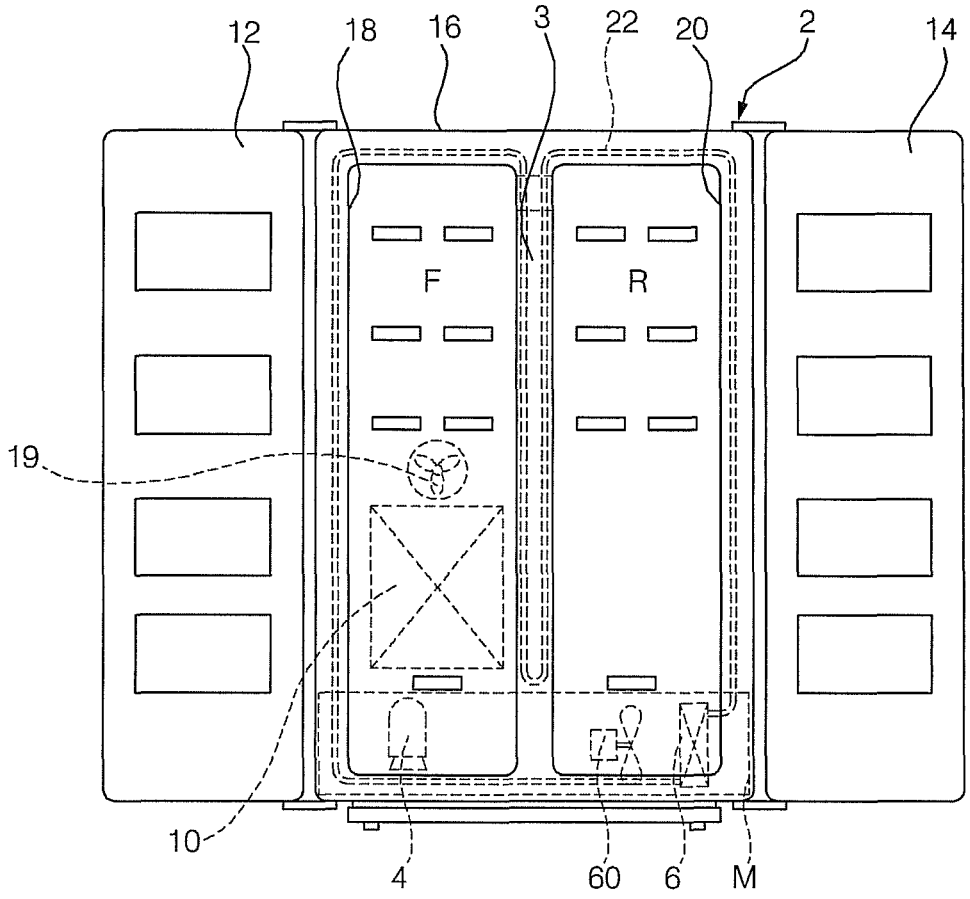
FIG. 1 is a front view of a refrigerator, according to an embodiment as broadly described herein, with storage chamber doors thereof open.
Figure 2:
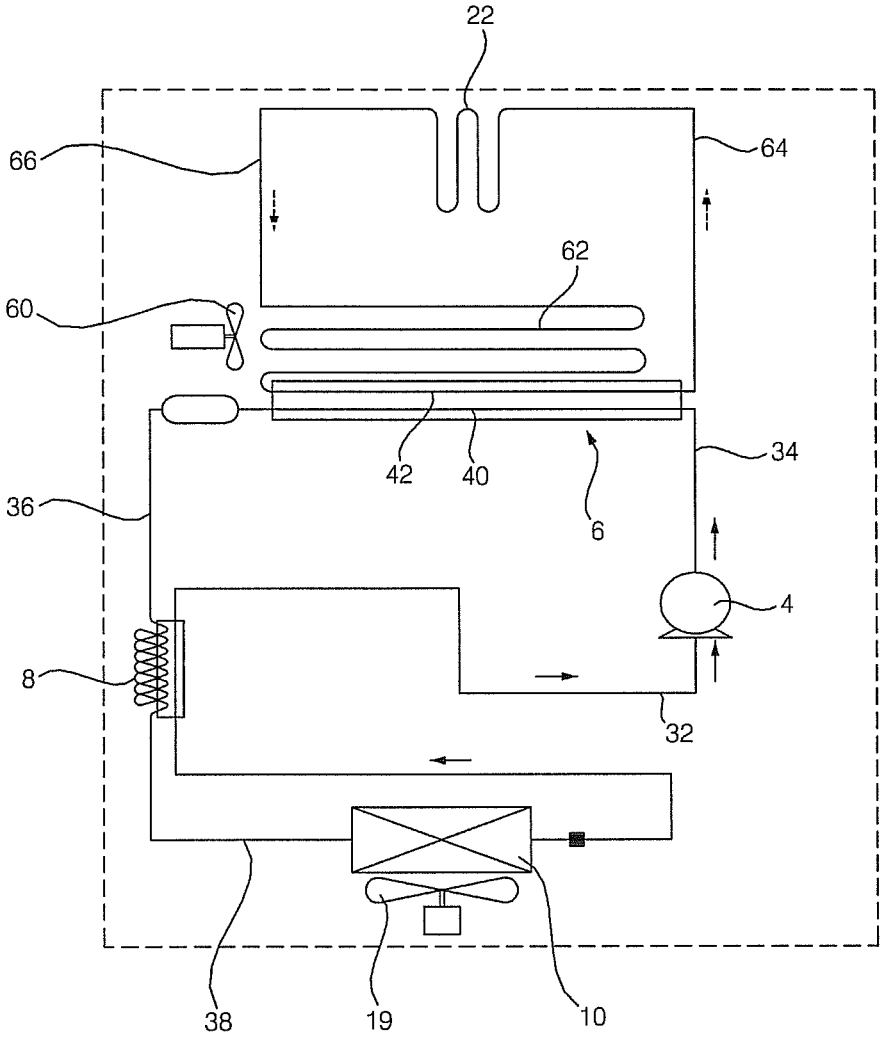
FIG. 2 is a schematic diagram of a flow of refrigerant and working fluid in the refrigerator shown in FIG. 1.

As shown in FIGS. 1 and 2, a refrigerator as embodied and broadly described herein may include a body 2 having storage chambers formed therein, a compressor 4 that compresses a refrigerant, a condenser 6 that condenses the refrigerant compressed by the compressor 4, an expansion device 8 that expands the refrigerant condensed by the condenser 6, and an evaporator 10 that evaporates the refrigerant expanded by the expansion device 8 to cool the storage chambers.

One or more storage chambers may be formed in the body 2. When a plurality of storage chambers is formed, a freezer compartment F and a refrigerator compartment R may be formed in the body 2. Doors opening/closing chambers may be mounted on the body 2. When the freezer compartment F and the refrigerator compartment R are formed in the body

2, a freezer compartment door 12 opening/closing the freezer compartment F and a refrigerator compartment door 14 opening/closing the refrigerator compartment R may be coupled to the body 2. A machine room where the compressor 4 and other such components be installed may be formed in the body 2, separately from the storage chambers. The body 2 may include an outer case 16 forming an exterior of the refrigerator, a freezer compartment-inner case 18 disposed inside the outer case 16 and defining the freezer compartment F, and a refrigerator compartment-inner case 20 disposed inside the outer case 16 and defining the refrigerator compartment R. When the freezer compartment door 12 and the refrigerator compartment door 14 of the refrigerator are open, a front plate 3 of the body 2 may be fully or partially exposed to the outside, and when the freezer compartment door 12 and the refrigerator compartment door 14 are closed, the doors 12 and 13 cover the front plate 3 of the body 2 and may contact the front plate 3 of the body 2. The front plate 3 of the body 2 may be formed by bending a portion of the outer case 16. The front plate 3 of the body 2 may include a bent portion extending from the freezer compartment-inner case 18 and a bent portion extending from the refrigerator compartment-inner case 20. A separate front cover forming the front external appearance of the body 2 may be used as the front plate 3 of the body 2. A hot line 22 that may prevent air from condensing on the front plate 3 or that may remove condensed water accumulated on the front plate 3 by heating the front plate 3 may be disposed in the body 2. The hot line 22 may be disposed, for example, in the front plate 3 of the body 2. The hot line 22 may be disposed, for example, behind the front plate 3 of the body 2. In this exemplary embodiment, not a refrigerant circulating through the compressor 4, condenser 6, expansion device 8, and evaporator 10, but a working fluid different from the refrigerant, may pass through the hot line 22. In this case, a separate portion of a refrigerant channel through which a refrigerant passes, behind the front plate 3 of the body 2, is not needed. The working fluid may be, for example, water or methyl alcohol, or heat carriers that may evaporate and condense in a relatively low temperature range. The hot line 22 may transmit the heat from the working fluid to the front plate 3 of the body 2 as the working fluid passes through the hot line 22. When high-temperature working fluid passes through the hot line 22, the front plate 3 of the body 2 may be heated by the heat transmitted through the hot line 22 from the working fluid.

A compressor intake channel 32 guides the refrigerant that has passed through the evaporator 10 to the compressor 4. A compressor discharge channel 34 guides refrigerant compressed by the compressor 4 to the condenser 6. The compressor discharge channel 34 may guide refrigerant to a refrigerant condensation channel 40 for the condenser 6, with one end of the compressor discharge channel 34 connected to the compressor 4 and the other end connected to the refrigerant condensation channel 40.

The condenser 6 may be a water-cooling heat exchanger that makes the refrigerant, which is compressed by the compressor 4, exchange heat with working fluid. The condenser 6 may be an air/water-cooling heat exchanger that makes the refrigerant, which is compressed by the compressor 4, exchange heat with both of working fluid and air. It may be possible to reduce an overall size of the condenser 6 when the condenser is an air/water-cooling heat exchanger than when it is a water-cooling heat exchanger. The refrigerant condensation channel 40 through which the refrigerant from the compressor 4 passes and a working fluid evaporation channel 42 through which the working fluid evaporates by exchanging heat with the refrigerant in the refrigerant condensation channel 40 are formed in the condenser 6.

The condenser 6 is connected to the hot line 22 by hot line circulation channels 64 and 66. The hot line circulation channels 64 and 66 can form a closed thermosiphon by connecting the condenser 6 and the hot line 22. The hot line circulation channels 64 and 66 can connect the working fluid evaporation channel 42 of the condenser 6 and the hot line 22. The working fluid evaporation channel 42 of the condenser 6, the hot line circulation channels 64 and 66, and the hot line 22 can form a closed thermosiphon. The working fluid evaporation channel 42 of the condenser 6 may function as an evaporator in the closed thermosiphon and the hot line 22 may function as a condenser in the closed thermosiphon. The working fluid may flow to the hot line 22 after being evaporated through the working fluid evaporation channel 42 and passing through the hot line 22, and then it may be condensed while discharging heat around the hot line 22. The working fluid may flow to the working fluid evaporation channel 42 after being condensed through the hot line 22 and passing through the working fluid evaporation channel 42, and may then evaporate by taking heat from the refrigerant passing through the refrigerant condensation channel 40. The working fluid that has evaporated through the working fluid evaporation channel 42 may be sent to the hot line 22 due to a pressure difference generated by a temperature difference between the working fluid, evaporation channel 42 and the hot line 22. The working fluid evaporation channel 42 may be higher in temperature and pressure than the hot line 22 and the high-pressure working fluid in the working fluid evaporation channel 42 may flow to the hot line 22 at a lower temperature than the working fluid evaporation channel 42. The working fluid discharging heat through the hot line 22 after flowing to the hot line 22 may be sent to the working fluid evaporation channel 42 due to gravity. The condenser 4 may be positioned in the body 2 lower than the hot line 22. The refrigerator may include a condenser fan 60 sending air to the condenser 6.

The condenser 4 may further include a working fluid heat discharge tube 62 discharging heat from the working fluid. The working fluid from the hot line 22 may pass through the working fluid heat discharge tube 62. The working fluid heat discharge tube 62 may be connected with the working fluid evaporation channel 42. The working fluid heat discharge tube 62 may function as a working fluid cooler that cools the working fluid before the working fluid condensed through the hot line 22 evaporates through the working fluid evaporation channel 42. The working fluid heat discharge tube 62 can make air and the working fluid exchange heat. The working fluid heat discharge tube 62 may be arranged such that the air from the condenser fan 60 and the working fluid exchange heat.

When the condenser 4 includes the working fluid heat discharge tube 62, the hot line circulation channel may include a hot line inlet channel 64 that guides the working fluid evaporated through the working fluid evaporation channel 42 to the hot line 22 and a hot line outlet channel 66 that guides the working fluid condensed through the hot line 22 to the working fluid heat discharge tube 62.

When the condenser 4 does not include the working fluid heat discharge tube 62, the hot line circulation channel may include the hot line inlet channel 64 that guides the working fluid evaporated through the working fluid evaporation channel 42 to the hot line 22 and the hot line outlet channel 66 may guide the working fluid condensed through the hot line 22 to the working fluid evaporation channel 42.

That is, the hot line outlet channel may connect the hot line 22 and the working fluid heat discharge tube 62, when the condenser 4 includes the working fluid heat discharge tube 62, and it may connect the hot line 22 and the working fluid evaporation channel 42, when the condenser 4 does not include the working fluid heat discharge tube 62.

The refrigerant condensation channel 40 and the working fluid evaporation channel 42 may separated with a heat transfer member positioned therebetween. The heat of the refrigerant passing through the refrigerant condensation channel 40 may transfer to the working fluid in the working fluid evaporation channel 32 through the heat transfer member, so the refrigerant may be condensed by having the heat taken to the working fluid and the working fluid may be evaporated by taking the heat from the refrigerant. The heat transfer member may function as a heat transfer device that makes the refrigerant and the working fluid exchange heat, in addition to functioning as a separator that separates the refrigerant condensation channel 40 and the working fluid evaporation channel 42.

The expansion device 8 may be, for example, a capillary tube or an electronic expansion valve, which expands the refrigerant condensed through the condenser 6, particularly through the refrigerant condensation channel 42. The expansion device 8 may be connected with the refrigerant condensation channel 42 of the condenser 6 by an expansion device inlet channel 36 and with the evaporator 10 by an expansion device outlet channel 38.

The evaporator 10 may be disposed in the freezer compartment-inner case 18 or the refrigerator compartment-inner case 20 and the refrigerator may include an evaporator fan 19 sending air to the evaporator 10. The evaporator fan 19 may take the air from at least one of the freezer compartment F or the refrigerator compartment R into the evaporator 10 and make the air exchange heat with the evaporator 10, and it may send the cold air that has exchanged heat with the evaporator 10 to at least one of the freezer compartment F or the refrigerator compartment R.

The compressor 4, condenser 6, expansion device 8, and evaporator 10 may form a refrigeration cycle of the refrigerant. The condenser 6 and the hot line 22 may form a thermosiphon for the working fluid. The condenser 6 may function as a refrigerant-working fluid heat exchanger that causes the refrigerant circulating through the refrigeration cycle to exchange heat with the working fluid circulating through the thermosiphon.

Figure 3:
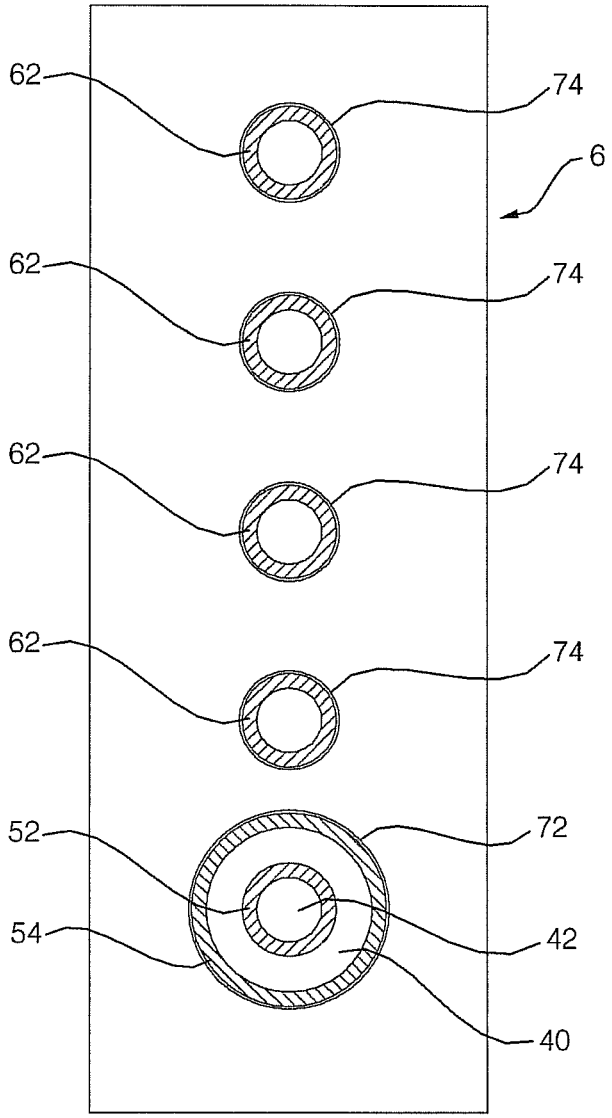
FIG. 3 is a cross-sectional view of a condenser of the refrigerator shown in FIG. 1.
Figure 4:
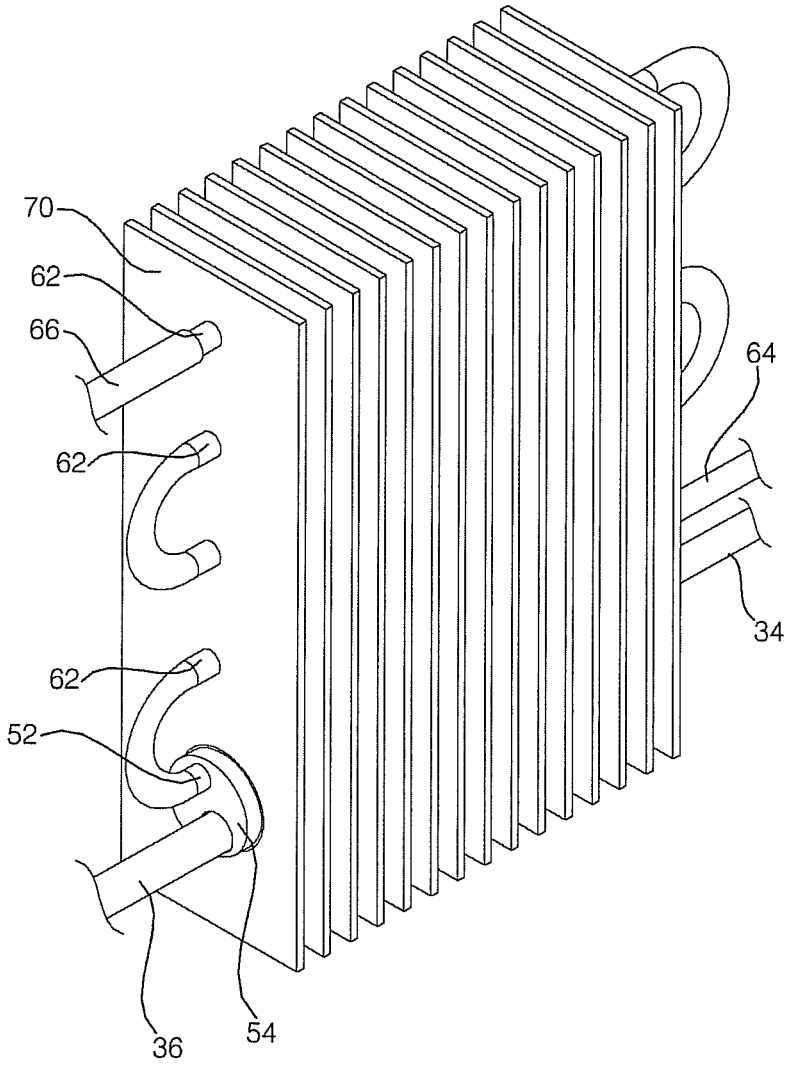
FIG. 4 is a perspective view of the shown in FIG. 3.

FIG. 3 is a cross-sectional view showing of a condenser of a refrigerator as embodied and broadly described herein and FIG. 4 is a perspective view of the condenser shown in FIG. 3.

The condenser 6 may include an inner pipe 52 in which one of the refrigerant condensation channel 40 or the working fluid evaporation channel 42 is formed and an outer pipe 54 which surrounds the inner pipe 52 and in which the other of the refrigerant condensation channel 40 or the working fluid evaporation channel 42 is formed between the pipes 52 and 54. The condenser 6 may be a dual pipe heat exchanger including the inner pipe 52 and the outer pipe 54.

The inner pipe 52, which is positioned between the refrigerant condensation channel 40 and the working fluid evaporation channel 42, may be a heat transfer member that separates the refrigerant condensation channel 40 and the working fluid evaporation channel 42 and transfers heat between the refrigerant and the working fluid. The working fluid evaporation channel 42 may be formed in the inner pipe 52 and the refrigerant condensation channel 40 may be formed between the inner pipe 52 and the outer pipe 54.

Alternatively, the refrigerant condensation channel 40 may be formed in the inner pipe 52 and the working fluid evaporation channel 42 may be formed between the inner pipe 52 and the outer pipe 54.

When the working fluid evaporation channel 42 is formed in the inner pipe 52 and the refrigerant condensation channel 40 is formed between the inner pipe 52 and the outer pipe 54, the refrigerant may be cooled in a water-cooling type arrangement by exchanging heat with the working fluid in the inner pipe 52 and may also be cooled in an air-cooling type arrangement by exchanging heat with the air coming in contact with the outer side of the outer pipe 54. In this configuration, the refrigerant compressed by the compressor 4 may be efficiently cooled by the condenser 6 through both water-cooling and air-cooling. Further, since the working fluid evaporation channel 42 is surrounded by the refrigerant condensation channel 40, the working fluid may absorb the heat from the refrigerant with a minimum loss of heat. The inner pipe 52 may be a water-cooling heat exchanging member that causes the working fluid and the refrigerant to exchange heat and the outer pipe 54 may be an air-cooling heat exchanging member that causes the refrigerant and air to exchange heat.

When the working fluid evaporation channel 42 is formed in the inner pipe 52 and the refrigerant condensation channel 40 is formed between the inner pipe 52 and the outer pipe 54, the compressor outlet channel 34 and the expansion inlet channel 36 shown in FIG. 2 may be connected to the outer pipe 54, the hot line inlet channel 64 may be connected to one end of the inner pipe 52, and the working fluid heat discharge tube 62 or the hot line outlet channel 66 may be connected to the other end of the inner pipe 52. When the condenser 6 includes the working fluid heat discharge tube 62, the inner pipe 52 may be connected with the hot line inlet channel 64 and the working fluid heat discharge tube 62. When the condenser 6 does not include the working fluid heat discharge tube 62, the inner pipe 52 may be connected with the hot line inlet channel 64 and the hot line outlet channel 66.

The condenser fan 60 shown in FIG. 2 may send air to the outer pipe 54, or may send air to both of the working fluid heat discharge tube 62 and the outer pipe 54.

The working fluid heat discharge tube 62 may be arranged such that the working fluid that has condensed through the hot line 22 may flow to the working fluid evaporation channel 42 due to gravity. The working fluid heat discharge tube 62 may be positioned higher than the working fluid evaporation channel 42. The working fluid heat discharge tube 62 may be positioned higher than the outer pipe 54. The working fluid heat discharge tube 62 may be arranged in a zigzag pattern and may change direction, or zigzag, two or more times. The working fluid heat discharge tube 62 may include a plurality of straight tubes and a plurality of curved tubes connecting two of the straight tubes.

The condenser 6 may further include heat discharge fins 70 in contact with at least one of the outer pipe 54 or the working fluid heat discharge tube 62. The heat discharge fins 70 may be arranged spaced apart in the length direction of the outer pipe 54. The heat discharge fins 70 may be arranged in contact with the outer pipe 54, but not in contact with the working fluid heat discharge tube 62. The heat discharge fins 70 may be arranged in contact with the working fluid heat discharge tube 62, but not in contact with the outer pipe 54. The heat discharge fins 70 may be arranged in contact with the outer pipe 54 and the working fluid heat discharge tube 62.

The heat discharge fins 70 may include outer pipe heat discharge fins that are arranged in contact with the outer pipe 54, but not in contact with the working fluid heat discharge tube 62.

The heat discharge fins 70 may include working fluid heat discharge fins that are arranged not in contact with the outer pipe 54, but are in contact with the working fluid heat discharge tube 62.

The heat discharge fins 70 may include outer pipe heat discharge fins in contact with the outer pipe 54 but not in contact with the working fluid heat discharge tube 62 and working fluid heat discharge fins in contact with the working fluid heat discharge tube 62 but not in contact with the outer pipe 54.

The heat discharge fins 70 may include heat discharge fins 70 in contact with the working fluid heat discharge tube 62 and the outer pipe 54. When the heat discharge fins 70 are in contact with the working fluid heat discharge tube 62 and the outer pipe 54, the portion close to the working fluid heat discharge tube 62 may help the working fluid discharge heat and the portion close to the outer pipe 54 may help the refrigerant discharge heat. In this configuration, the heat discharge fins 70 may be common heat discharge fins helping the refrigerant and the working fluid discharge heat. When the heat discharge fins 70 are common heat discharge fins, an outer pipe hole 72 in which the outer pipe 54 is disposed in contact with it and a working fluid heat discharge tube hole 74 in which the working fluid heat discharge tube 62 is disposed in contact with it may be formed in the heat discharge fins 70. The outer pipe hole 72 may be larger than the working fluid heat discharge tube hole 74.

The condenser fan 60 shown in FIG. 2 may send air to both of the outer pipe 54 and the working fluid heat discharge tube 62, when the condenser 6 further includes the working fluid heat discharge tube 62. The air sent to the working fluid heat discharge tube 62 by the condenser fan 60 may help the working fluid discharge heat and the air sent to the outer pipe 54 by the condenser fan 60 may help the refrigerant discharge heat.

During operation, first, when the compressor 4 operates, the compressor 4 may compress and output a refrigerant at high temperature and high pressure. When the compressor 4 operates, the condenser fan 60 may operate to send air to the condenser 6 and the air may exchange heat with the working fluid heat discharge tube 62, the outer tube 54, and the heat discharge fins 70 in contact with them.

The refrigerant discharged from the compressor 4 may discharge heat to the working fluid in the working fluid evaporation channel 42 and the air outside the outer pipe 54 while passing through the refrigerant condensation channel 40 of the condenser 6, such that it may be cooled by water-cooling and by air-cooling while passing through the refrigerant condensation channel 40 of the condenser 6. The refrigerant that has passed through the refrigerant condensation channel 40 of the condenser 6 may flow to the expansion device 8 through the expansion device inlet channel 36 and may then be expanded by the expansion device 8. The refrigerant expanded by the expansion device 8 may flow to the evaporator 10 through the expansion device outlet channel 38 and may then cool the air from the storage chambers while passing through the evaporator 10. The refrigerant passing through the evaporator 10 may evaporate by exchanging heat with the air from the storage chambers and may then be sucked into the compressor 4 through the compressor intake channel 32.

Further, when the refrigerant compressed at high temperature and high pressure by the compressor 4 passes through the refrigerant condensation channel 40, the working fluid in the working fluid evaporation channel 42 may receive the heat transferred through the inner pipe 52 and may evaporate (liquid state→gas state) by taking the heat transferring through the inner pipe 52. The working fluid evaporated through the working fluid evaporation channel 42 may flow to the hot line inlet channel 64 due to the temperature difference between the working fluid evaporation channel 42 and the hot line 22 and may flow into the hot line 22 through the hot line inlet channel 64, because the working fluid evaporation channel 42 is higher in temperature than the hot line 22. The working fluid flowing in the hot line 22 may discharge heat around through the hot line 22 and may condense (gas state→liquid state) by having heat taken around the hot line 22. The working fluid in the hot line 22 may flow to the hot line outlet channel 66 due to gravity and may pass through the working fluid heat discharge tube 62 through the hot line outlet channel 66. The working fluid passing through the working fluid heat discharge tube 62 may discharge heat through air-cooling and decrease in temperature by exchanging heat with the air from the condenser fan 60. The working fluid in the working fluid heat discharge tube 62 may flow to the working fluid evaporation channel 42 due to gravity and the working fluid cooled through air-cooling may flow into the working fluid evaporation channel 42. The working fluid flowing in the working fluid evaporation channel 42 may evaporate again by taking the heat from the refrigerant. The working fluid may minimize condensation on the front panel 3 of the body 2 by circulating in the order of the working fluid evaporation channel 42, the hot line inlet channel 64, the hot line outlet channel 66, and the working fluid heat discharge tube 62.

The refrigerator may be configured such that the refrigerant passes through the hot line 22, the hot line 22 is disposed at the downstream side of the refrigerant condensation channel 40 in the refrigerant flow direction, and the refrigerant that has passed through the refrigerant condensation channel 40 directly flows into the hot line 22. In some circumstances, the pressure and the temperature at the outlet of the refrigerant condensation channel 40 would be increased in order to maintain the temperature of the refrigerant passing through the hot line 22 at a predetermined level or more, thus increasing the power consumption of the compressor 4 and the power consumption of the refrigerator. However, since the working fluid passing through the working fluid evaporation channel 42 receives heat from the refrigerant condensation channel 40 and transmits the heat to the hot line 22, it is not necessary to operate the compressor 4 at high pressure and high temperature at the outlet of the refrigerant condensation channel 40 and it may be possible to reduce the pressure and the temperature at the outlet of the refrigerant condensation channel 40, such that the power consumption may be minimized.

In an embodiment that does not include the working fluid heat discharge tube 62, the condenser fan 60 may send air to the outer pipe 54. The heat discharge fins 70 may be in contact with the outer pipe 54 and accelerate the discharge of heat of the refrigerant passing through the outer pipe 54. Further, the working fluid evaporation channel 42 and the refrigerant condensation channel 40 may be plate-shaped heat exchangers, the working fluid heat discharge tube 62 may be connected to the working fluid evaporation channel 42 of the plate-shaped heat exchangers, such that various embodiments may be realized in various ways within the scope as broadly described herein.

A refrigerator as embodied and broadly described herein may increase available storage space and reduce power consumption of a compressor with a simple structure.

A refrigerator as embodied and broadly described herein may include a body with storing chambers; a compressor that compresses a refrigerant; a condenser that condensates the refrigerant compressed by the compressor; an expansion device that expands the refrigerant condensed by the condenser; and an evaporator that evaporates the refrigerant expanded by the expansion device to cool the storing chambers, in which the condenser has a refrigerant condensation channel through which the refrigerant from the compressor passes and a working fluid evaporation channel through which working fluid evaporates by exchanging heat with the refrigerant passing through the refrigerant condensation channel, and the condenser is connected with a hot line, through which the working fluid evaporating through the working fluid evaporation channel condensates by discharging heat, by hot line circulation channels.

The refrigerant condensation channel and working fluid evaporation channel may be separated with a heat transfer member therebetween.

The condenser may include an inner pipe in which any one of the refrigerant condensation channel and working fluid evaporation channel is formed; and an outer pipe which surround the inner pipe and in which the other one of the refrigerant condensation channel and working fluid evaporation channel is formed between the inner pipe and the outer pipe.

The refrigerator may further include a condenser fan sending air to the outer pipe.

The refrigerant condensation channel may be formed between the outer pipe and the inner pipe.

The hot line circulation channel may include a hot line inlet channel that guides the working fluid evaporated through the working fluid evaporation channel to the hot line; and a hot line outlet channel that guides the working fluid condensed through the hot line to the working fluid evaporation channel.

The refrigerator may further include a condenser fan sending air to the condenser, in which the condenser may further include a working fluid heat discharge tube through which the refrigerant from the hot line passes and which is connected with the working fluid evaporation channel and takes heat from the working fluid, using the air from the condenser fan.

The hot line circulation channel may include a hot line inlet channel that guides the working fluid evaporated through the working fluid evaporation channel to the hot line; and a hot line outlet channel that guides the working fluid condensed through the hot line to the working fluid heat discharge tube.

The condenser may include an inner pipe in which any one of the refrigerant condensation channel and working fluid evaporation channel is formed; an outer pipe which surround the inner pipe and in which the other one of the refrigerant condensation channel and working fluid evaporation channel is formed between the inner pipe and the outer pip; and a working fluid heat discharge tube through which the refrigerant from the hot line passes and which is connected with the working fluid evaporation channel and takes heat from the working fluid, using the air from the condenser fan.

The working fluid heat discharge tube may be positioned higher than the outer pipe.

The condenser may further include heat discharge fins that the outer pipe and the working fluid heat discharge tube are in contact with.

The heat discharge fins may have an outer pipe hole in which the outer pipe is disposed in contact with it and a working fluid heat discharge tube hole in which the working fluid heat discharge tube is disposed in contact with it.

The outer pipe hole may be larger than the working fluid heat discharge tube hole.

The refrigerator may further include a condenser fan sending air to the outer pipe and the working fluid heat discharge tube.

In the condenser, the working fluid evaporation channel may be formed in the inner pipe, and the refrigerant condensation channel may be formed between the inner pipe and the outer pipe.

A refrigerator as embodied and broadly described herein may include a body with storing chambers; a compressor that compresses a refrigerant; a condenser that condensates the refrigerant compressed by the compressor; an expansion device that expands the refrigerant condensed by the condenser; and an evaporator that evaporates the refrigerant expanded by the expansion device to cool the storing chambers, in which a hot line through which working fluid condenses by discharging heat is disposed in the body, the condenser has a refrigerant condensation channel through which the refrigerant from the compressor passes and a working fluid evaporation channel through which working fluid evaporates by exchanging heat with the refrigerant passing through the refrigerant condensation channel, the condenser has a working fluid heat discharge tube through which the refrigerant from the hot line passes and which takes heat from the working fluid, using the air from the condenser fan, and is connected with the working fluid evaporation channel, and the hot line circulation channel includes: a hot line inlet channel that guides the working fluid evaporated through the working fluid evaporation channel to the hot line; and a hot line outlet channel that guides the working fluid condensed through the hot line to the working fluid heat discharge tube.

The working fluid may circulate in the order of the working fluid evaporation channel, the hot line inlet channel, the hot line outlet channel, and the working fluid heat discharge tube.

The condenser may be positioned lower than the hot line in the body, and the working fluid heat discharge tube may be positioned higher than the working fluid evaporation channel.

The condenser may further include an inner pipe in which the working fluid evaporation channel is formed; an outer pipe which surrounds the inner pipe and in which the refrigerant condensation channel is formed between the inner pipe and the outer pipe; and heat discharge fins that are in contact with the working fluid heat discharge tube and the outer pipe.

A refrigerator as embodied and broadly described herein may include a body with storing chambers; a compressor that compresses a refrigerant; a condenser that condensates the refrigerant compressed by the compressor; an expansion device that expands the refrigerant condensed by the condenser; and an evaporator that evaporates the refrigerant expanded by the expansion device to cool the storing chambers, in which the condenser has a refrigerant condensation channel through which the refrigerant from the compressor passes and a working fluid evaporation channel through which working fluid evaporates by exchanging heat with the refrigerant passing through the refrigerant condensation channel, and the working fluid evaporation channel and the hot line are connected to a hot line circulation channel forming a thermosiphon.

In a refrigerator as embodied and broadly described herein, since the working fluid takes heat from the refrigerant and transmits it to the hot line while passing through the condenser, it may be possible to prevent condensation with a simple structure and increase available space by returning wasted heat from a compressor.

In a refrigerator as embodied and broadly described herein, since the working fluid flowing from the hot line may flow into the working fluid evaporation channel after air absorbs heat, it may be possible for the high-temperature refrigerant and the low-temperature working fluid can efficiently exchange heat.

In a refrigerator as embodied and broadly described herein, since the refrigerant passing through the refrigerant condensation channel is cooled in a water-cooling type and an air-cooling type, the refrigerant compressed by the compressor may efficiently discharge heat.

In a refrigerator as embodied and broadly described herein, a number of heat discharge fins of the condenser may be minimized, and an overall size of the condenser may be reduced, thereby increasing available space.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a body having at least one storage chamber and a front plate that contacts at least one door of the refrigerator;

a compressor that compresses a refrigerant;

a condenser that condenses the refrigerant compressed by the compressor, wherein the condenser includes:

a refrigerant condensation channel that guides a flow of the refrigerant received from the compressor; and a working fluid evaporation channel that guides a flow of a working fluid therethrough, wherein the working fluid undergoes heat exchange with the refrigerant flowing in the refrigerant condensation channel and is evaporated;

an expansion device that expands the refrigerant condensed by the condenser;

a hot line that guides a flow of the working fluid evaporated in the working fluid evaporation channel therethrough to discharge heat from the working fluid to the front plate of the body and condense the working fluid;

a hot line inlet channel that guides the working fluid evaporated in the working fluid evaporation channel to the hot line;

a hot line outlet channel that guides the working fluid condensed in the hot line to the working fluid evaporation channel; and a condenser fan that blows air toward the condenser, wherein the condenser further includes a working fluid heat discharge tube, which is connected between the hot line outlet channel and the working fluid evaporation channel and discharges heat from the working fluid flowing therethrough to an outside therefrom by air blowing from the condenser fan, wherein the condenser includes:

an inner pipe in which the working fluid evaporation channel is formed;

an outer pipe which surrounds the inner pipe, wherein the refrigerant condensation channel is formed between the inner pipe and the outer pipe; and a plurality of heat discharge fins which is in contact with the outer pipe and the working fluid heat discharge tube such that the working fluid passing through the working fluid heat discharge tube is cooled by being heat-exchanged with the heat discharge fins, and the refrigerant passing through the outer pipe is cooled by being heat-exchanged with the heat discharge fins and the working fluid passing through the inner pipe.

2. The refrigerator of claim 1, further including a heat transfer device provided between the refrigerant condensation channel and working fluid evaporation channel.

3. The refrigerator of claim 1, wherein the working fluid heat discharge tube is positioned higher than the outer pipe.

4. The refrigerator of claim 1, wherein the plurality of heat discharge fins each include an outer pipe hole in which the outer pipe is received and a working fluid heat discharge tube hole in which the working fluid heat discharge tube is received such that the outer pipe and the working fluid heat discharge tube maintain contact with each of the plurality of heat discharge fins at the outer pipe hole and the working fluid heat discharge tube hole, respectively.

5. The refrigerator of claim 4, wherein the outer pipe hole is larger than the working fluid heat discharge tube hole.

6. The refrigerator of claim 1, wherein the condenser fan blows air toward the outer pipe and the working fluid heat discharge tube.

7. The refrigerator of claim 1, wherein the hot line guides the working fluid directly from the condenser to the front plate of the body without passing through the compressor.

* * * * *